United States Patent [19]

Tuttle

[11] 4,121,427

[45] Oct. 24, 1978

[54] METHOD AND APPARATUS FOR SETTING PILINGS IN FROZEN GROUND

[76] Inventor: John K. Tuttle, Box 885 Dos Rios Rd., Gunnison, Colo. 81230

[21] Appl. No.: 832,337

[22] Filed: Sep. 12, 1977

[51] Int. Cl.[2] ..... E02D 5/74

[52] U.S. Cl. ..... 405/130; 405/234; 405/244

[58] Field of Search ..... 61/36 A, 53.5, 50, 53.74; 62/293, 260

[56] References Cited

U.S. PATENT DOCUMENTS

| | | | |
|---|---|---|---|
| 3,380,255 | 4/1968 | Schroeder | 61/36 A |
| 3,528,252 | 9/1970 | Gail | 61/36 A |

OTHER PUBLICATIONS

Construction Methods & Equip., Jun. 1956, pp. 62, 63, 64.

*Primary Examiner*—Jacob Shapiro
*Attorney, Agent, or Firm*—Ralph F. Crandell

[57] ABSTRACT

The present invention relates to a method for setting pilings, and to apparatus for use in conjunction therewith. More particularly, the invention relates to a new and improved method for temporarily setting and holding a piling in place for subsequent filling, packing and setting of material surrounding the ground imbedded portion of the piling. The present invention finds particular, but not necessarily exclusive utility in connection with setting pilings in frozen ground such as arctic tundra.

4 Claims, 5 Drawing Figures

Fig-2
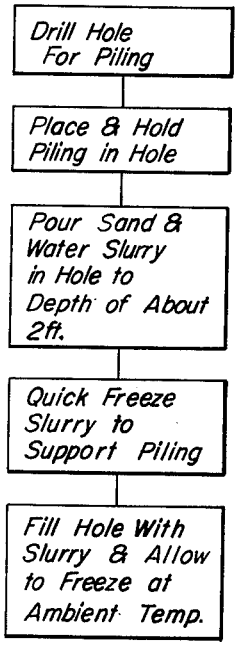
Fig-3
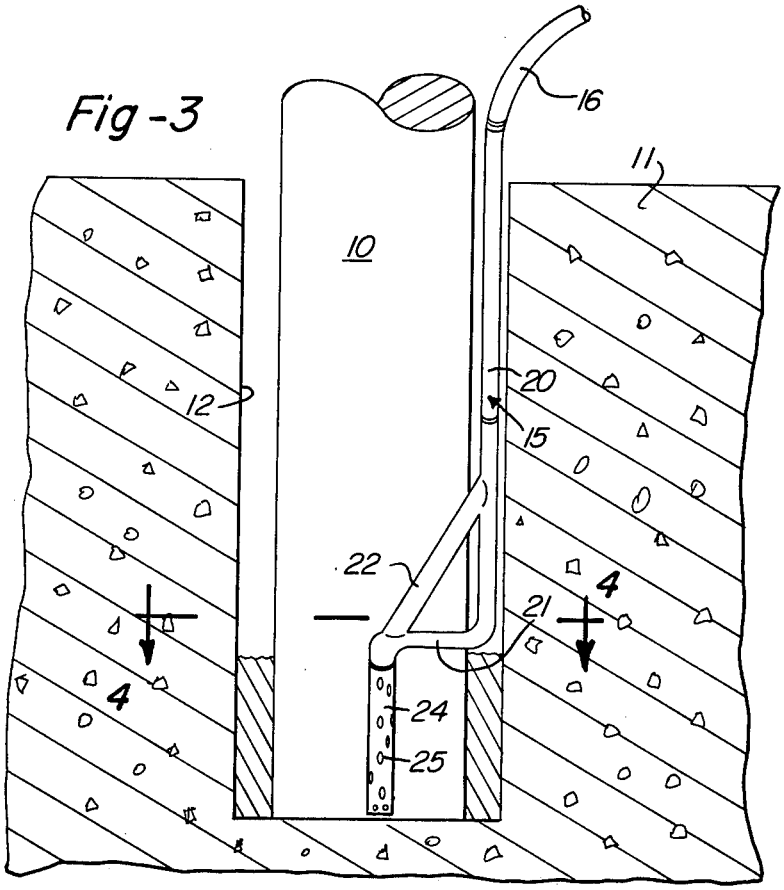
Fig-4
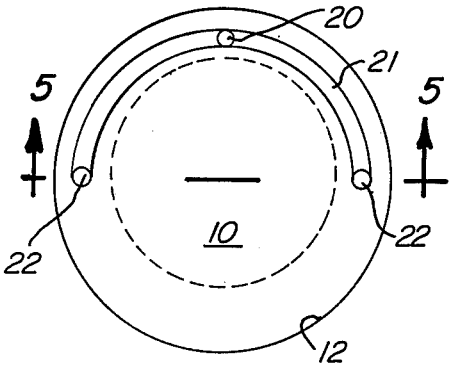
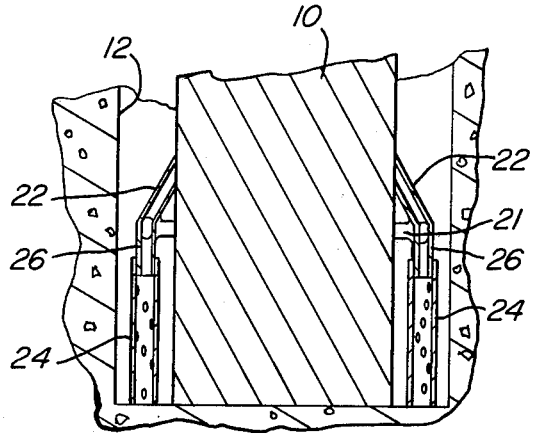
Fig-5

METHOD AND APPARATUS FOR SETTING PILINGS IN FROZEN GROUND

PRIOR ART

Where pilings or posts are to be set in normally frozen ground, such as the arctic tundra, it is conventional practice to drill an appropriate sized hole for receiving the portion of the piling to be imbedded, precisely locating and holding the piling in the desired orientation within the hole, and pouring a water-sand slurry into the hole surrounding the piling. Because the ground is at a temperature below the freezing point of water, the slurry will gradually freeze to hold the piling securely in place. Under normal conditions, arctic tundra, for example, will freeze the slurry in approximately 8 hours. During that time, it is necessary to hold the piling so that it does not tip and move out of its desired alignment.

OBJECTS OF THE INVENTION

It is the principal object of the present invention to provide a method and apparatus by which a piling can be readily temporarily set in a hole and held in place without the use of external equipment during the time it takes for the packing material to freeze or set.

A related object is to provide an improved apparatus for temporarily setting and holding a piling in place while the piling packing slurry sets to a rigid condition in order to securely support the piling in a ground imbedded relationship while maintaining the desired piling position and alignment.

It is another object of the present invention to provide a method and apparatus for setting pilings, posts and the like which is simple and economical, which increases the rate at which such pilings or posts can be set, and which insures that the pilings or posts will be securely and accurately positioned in place in the desired orientation and alignment.

A further object of the present invention is to provide a method and apparatus for setting posts and pilings of the foregoing character which does not require expensive equipment for holding and aligning the pilings during the setting time of the piling packing material.

Still a further object of the present invention is to provide a method and apparatus for setting pilings which finds particular but not necessarily exclusive utility for setting pilings and posts in frozen ground such as arctic tundra.

Other objects and advantages of the present invention will be apparent from the description and drawings thereof.

DESCRIPTION OF THE DRAWINGS

FIG. 2 is a block flow diagram setting forth the method of the present invention.

FIG. 3 is a vertical cross section view of the ground imbedded portion of a piling being set in place utilizing the method and apparatus of the present invention.

FIG. 4 is a section view taken substantially in the plane of line 4—4 on FIG. 3.

FIG. 5 is a section view taken substantially in the plane of line 5—5 on FIG. 4.

SUMMARY OF THE INVENTION

Figure 1:
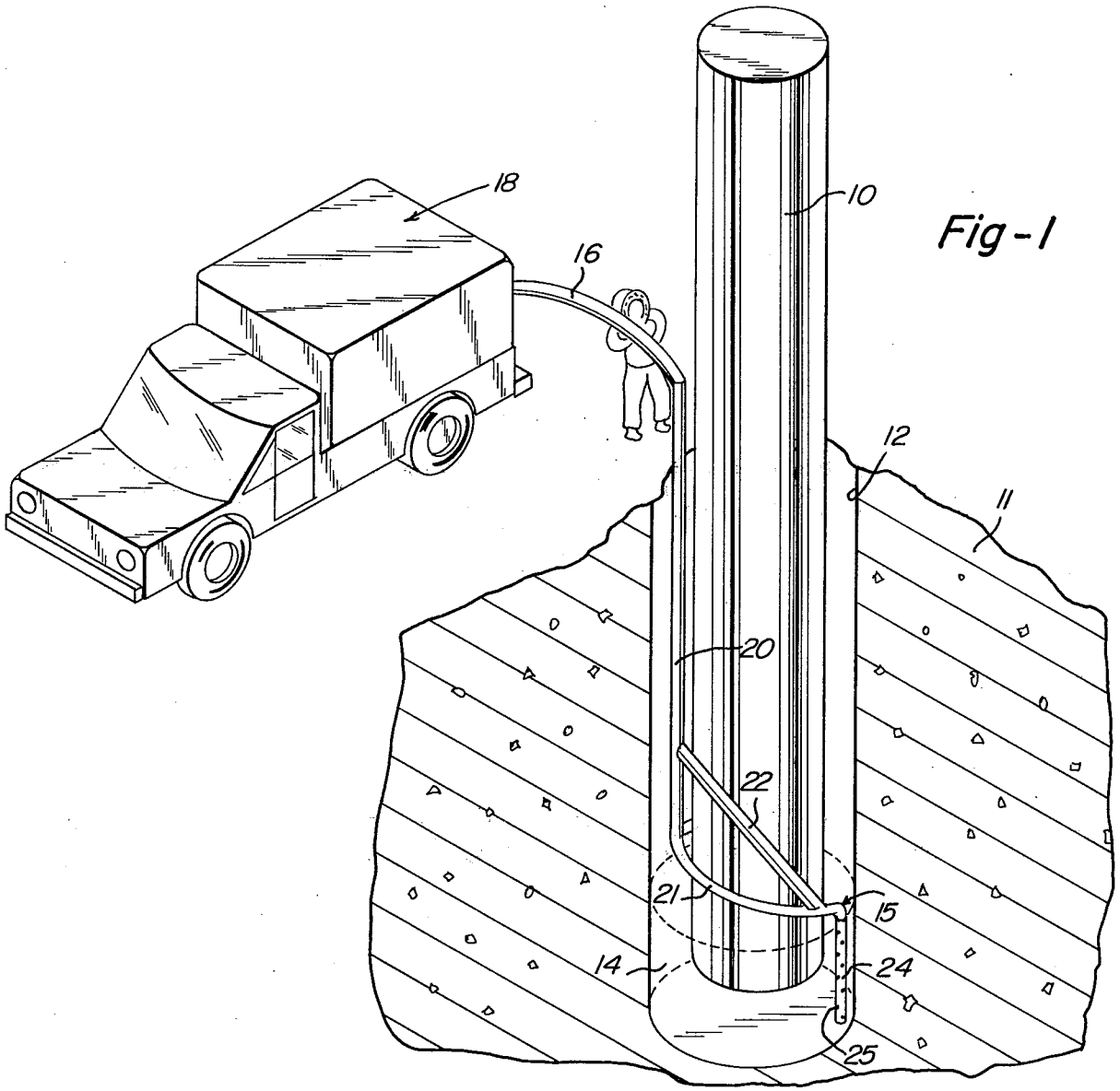
FIG. 1 is a perspective view of a piling being set in place utilizing the method and apparatus embodying the present invention.

In accordance with the foregoing objects, a piling is set in the ground such as frozen arctic tundra by first drilling an appropriate hole to a depth and in the alignment desired. The piling is inserted into the hole and, in accordance with the present invention, is held in place by filling the annular space surrounding the piling to a depth of approximately two feet with a sand and water slurry. While holding the pile in position, a cryogenic applicator is lowered into the hole in the annular space between the piling and the hole wall. The cryogenic applicator is inserted into the slurry and a cryogenic fluid is supplied through an appropriate conduit from a supply thereof on the surface ground. The fluid causes the quick-set slurry to freeze or set rapidly. Once set and frozen, the quick-set slurry securely holds and supports the piling in the desired location, alignment and arrangement in the hole. The cryogenic applicator is then withdrawn, leaving expendable portions frozen in the slurry. The hole is filled with a similar sand and water slurry or other material which is allowed to set and harden at ambient temperature. In the case of arctic tundra for example, the piling packing will gradually freeze and will thereby hold the piling securely in place.

DESCRIPTION OF THE PREFERRED EMBODIMENT

Referring to FIG. 1, a piling 10 is set in the ground 11, such as frozen arctic tundra, by first drilling an appropriate hole 12 to the depth and in the alignment desired. The piling 10 is inserted into the hole 12 and is held in place by an appropriate machine or other device (not shown) so as to be in the desired position and alignment. These steps are conventional, and conventional equipment, surveying techniques and the like are utilized.

In order to hold the packing 10 in place in the hole during the subsequent packing of the hole and freezing or setting of the packing material, the hole is first filled to a depth of approximately two feet with a sand and water slurry 14 or other material capable of being quick frozen.

While the piling holding and locating machine is holding the piling 10 in position, a cryogenic applicator 15 is lowered into the hole in the annular space between the piling 10 and the hole wall and inserted into the quick-set slurry 14. A cryogenic fluid is supplied to the applicator 15 through an appropriate cryogenic conduit 16, from a supply thereof contained in a truck 18 or other portable container. The cryogenic fluid causes the quick-set slurry 14 to freeze or set rapidly to securely hold and support the piling 10 in the desired location, alignment and arrangement in the hole 12. The cryogenic applicator 15 is then withdrawn from the hole. The hole 12 is then filled with a packing slurry (not shown) up to the ground surface level. The packing slurry is allowed to freeze or set over whatever time period is required. During the setting of the principal packing slurry, the piling is held securely in position by the quick-set frozen temporary setting material 14 in the bottom of the hole 12.

The cryogenic apparatus 15 utilized in connection with the present invention is adapted to be inserted into the hole and the annular space between the piling and the hole walls. The cryogenic apparatus 15 is shown in more detail in FIGS. 3, 4 and 5. This apparatus is formed by an elongated vertical down-hole conduit 20 carrying at its lower end a generally arcuate semi-circular manifold 21. In order to fill the manifold 21 with the desired cryogenic fluid as rapidly as possible, a pair of outwardly inclined feeder conduits 22 connect the outer ends of the arcuate manifold 21 with the conduit 20. For directing the cryogenic fluid into the temporary setting quick-set slurry 14, the feeder manifold carries a plurality, two as shown in the drawings, of downwardly extending expendable feeder conduits 24, each of which is provided with a plurality of apertures 25 through which the cryogenic fluid is fed to the surrounding slurry. The depending feeder conduits 24 are releasably connected to downwardly depending nozzles 26 on the manifold 21. These expendable feeder conduits 24 are frozen tightly into the slurry by the cryogenic fluid. When the cryogenic apparatus is lifted from the hole, the nozzles 26 readily release from the feeder conduits 24 leaving the latter imbedded in the frozen slurry 14.

The cryogenic material useful in accordance with the present invention is preferably a cryogenic gas such as liquid air, liquid nitrogen or the like. Such a gas is readily available and is conveniently supplied through an appropriately insulated conduit and the cryogenic apparatus 15. Such a material is preferably of such a nature that it effects a rapid and substantially complete freezing of the quick-set slurry 14 in a relatively short period of time.

To summarize the method of the present invention as outlined in FIG. 2, a hole is drilled in the ground in which the piling is to be located. The piling is then placed and held in the desired alignment in the hole. A sand and water slurry is poured into the hole to a depth of about two feet and quick frozen to support the piling by the application thereto of a cryogenic fluid. When the sand and water slurry has been quick frozen, the piling is temporarily but securely held in place in the desired alignment and location. The hole is then filled with the packing slurry, which may also be a sand and water slurry and the packing slurry is allowed to freeze at the ambient temperature. In the case of arctic tundra for example, the ambient ground temperature will be approximately −10° C. (13° F.).

It will be appreciated that the method and apparatus of the present invention could likewise be utilized in connection with the setting of pilings in warmer climates. For example, an appropriate quick hardenable slurry could be utilized for the temporary support of the piling followed by the application of concrete in the balance of the hole to hold the piling securely in place. The temporary quick setting material would hold the piling, post or other object in place while the concrete sets thereby avoiding the necessity for complex equipment, or other blocking and supporting measures to insure that the piling is held securely in place in the desired alignment and location. The apparatus for effecting the quick setting of the temporary material would be substantially similar to that described above.

The present invention has the further advantage that once the piling has been temporarily set, the surface supporting equipment may be removed, and buttresses or other attachable appurtenances may be welded or otherwise secured to the piling while the same is being permanently set. This would be of particular advantage in more hospitable climates in that it would allow work to progress at a more rapid rate.

While a certain illustrative method and apparatus embodying the present invention has been shown in the drawings and described above in considerable detail, it should be understood that there is no intention to limit the invention to the specific forms disclosed. On the contrary, the intention is to cover all modifications, alternatives, alternative constructions, equivalents and uses falling within the spirit and scope of the invention as expressed in the appended claims.

I claim as my invention:

1. A method for setting pilings comprising the steps of:

drilling a hole for receiving the piling;

placing and holding the piling in the desired position and alignment in the hole;

pouring a freezable water and sand slurry into the hole around the piling to a depth of about two feet;

quick freezing the sand and water slurry to temporarily support the piling;

filling the hole with a settable slurry and allowing the same to set at ambient temperature.

2. In a method for setting pilings including drilling a hole for receiving the piling and placing and holding the piling in the desired arrangement and alignment within the hole, the improvement comprising pouring a quick freezable sand and water slurry into the hole to a depth of about two feet surrounding said piling, applying a cryogenic fluid to said slurry to quick-freeze said slurry and thereby support said piling securely within said hole, and filling said hole with a packing slurry and allowing said packing slurry to set at the ambient temperature to permanently support said piling in said hole.

3. An apparatus for applying a cryogenic fluid to a sand and water slurry at the bottom of a hole containing a piling for purposes of temporarily supporting said piling in said hole, said apparatus comprising an elongated conduit adapted for insertion into said hole after said piling is in place to extend down said hole in the space between said piling and said hole, a generally arcuate manifold supported at the lower end of said conduit, feed conduit connecting said main conduit with said manifold, a plurality of downwardly extending nozzles depending from said manifold, an expendable distributor conduit releasably secured on each nozzle and adapted to extend within a freezable sand and water slurry, whereby when a cryogenic fluid is supplied through said conduit and manifold to said distributor tubes a sand and water slurry is frozen adjacent the lower end of said piling and said apparatus can be withdrawn from said hole by separating said nozzles from said distributor tubes leaving said expendable distributor tubes imbedded within the quick frozen sand and water slurry and with said quick frozen water and said slurry temporarily supporting said piling in said hole.

4. An apparatus for quick freezing a sand and water slurry at the bottom of a hole surrounding an inserted piling comprising an elongated conduit adapted for insertion downwardly into said hole after said piling is in place, a manifold at the downhole end of said conduit, feeder tubes interconnecting said manifold and said conduit, a plurality of downwardly extending nipples on said manifold, and a relatively short perforated distributor tube releasably secured to each said nozzle whereby said conduit and manifold can be readily separated from said distributor tube when the latter are quick frozen in a freezable slurry by the application of a cryogenic fluid to said conduit manifold nozzles and distributor tubes.

* * * * *